US005622355A

United States Patent [19]

Kopp

[11] Patent Number: 5,622,355

[45] Date of Patent: Apr. 22, 1997

[54] LIFTING AND SUPPORTING APPARATUS

[76] Inventor: John G. Kopp, 2006 Via Vina, San Clemente, Calif. 92673

[21] Appl. No.: 528,834

[22] Filed: Sep. 15, 1995

[51] Int. Cl.[6] ..... B66F 3/00

[52] U.S. Cl. ..... 254/106; 254/133 A

[58] Field of Search ..... 254/105, 106, 254/108, 133 A, 134; 269/6

[56] References Cited

U.S. PATENT DOCUMENTS

| | | | |
|---|---|---|---|
| 500,940 | 7/1893 | Palmer | 254/106 |
| 595,216 | 12/1897 | Snell | 254/106 |
| 917,311 | 4/1909 | Kimble | 254/106 |
| 1,516,616 | 11/1924 | Meyer . | |
| 2,214,440 | 9/1940 | Rothery | 254/93 M |
| 2,217,403 | 10/1940 | Gunn | 254/106 |
| 2,629,267 | 2/1953 | Hart | 254/106 |
| 2,974,931 | 3/1961 | Reel et al. | 254/106 |
| 3,017,174 | 1/1962 | Reuter . | |
| 3,144,707 | 8/1964 | Hiestand | 254/108 |
| 3,185,318 | 5/1965 | Lewis | 254/108 |
| 4,081,112 | 3/1978 | Chang . | |
| 4,084,792 | 4/1978 | Baron et al. . | |
| 4,221,362 | 9/1980 | Van Santen . | |
| 4,757,975 | 7/1988 | Gordon et al. | 254/133 A |
| 5,161,787 | 11/1992 | Hobday . | |
| 5,215,288 | 6/1993 | Lyon | 254/134 |

*Primary Examiner*—Robert C. Watson

*Attorney, Agent, or Firm*—Gene Scott; Patent Law & Venture Group

[57] ABSTRACT

A lifting and supporting apparatus having a vertically oriented robe interconnected to a smaller, vertically oriented rod by a lifting device. A large bracket or the like is secured to the robe so as to provide a surface upon which an object can rest. The lifting device provides a means by which to move the rod downwardly with respect to the tube, thus allowing both the tube and the object to be easily raised and supported above the ground upon which the rod rests.

6 Claims, 2 Drawing Sheets

LIFTING AND SUPPORTING APPARATUS

BACKGROUND OF THE INVENTION

1. Field of the Invention

This invention relates generally to lifting devices, and more particularly to an improved lifting stand assembly designed to lift and support heavy equipment, particularly during the installation or repair of furnaces, air conditioning units and the like.

2. Description of Related Art

Invention and use of lifting stand devices is known to the public, as they are frequently used to aid in a variety of lifting procedures. For example, Meyer U.S. Pat. No. 1,516, 616 discloses a means for lifting a high placed object. As disclosed, the device includes a jacking means at a lower distal end and a support means at an upper distal end.

Reuter U.S. Pat. No. 3,017,174 discloses a jacking means which does not include a jacking device per se, but does include a work holder means at an upper distal end for holding and supporting a heavy object. Baron et al. U.S. Pat. No. 4,084,792 teaches a jacking device that includes a workpiece support attached to a vertical rod which may be telescopically jacked upward from a base structure. Van Santen U.S. Pat. No. 4,221,362 discloses a tall jack providing screw thread jacking means and a top mounted support plate. The device includes two telescopic square section tubes and narrow top and bottom plates are provided for the post, the plates being of a size for insertion within one of the tubes, and a cross pin is provided for insertion transversely through selected bores in the telescoped tubes.

Hobday U.S. Pat. No. 5,161,787 discloses an improved C-clamp that has a clamp body and a detachable setting mechanism. The clamp body has inner and outer legs with a hollow bore in the inner leg to allow passage of a stem having a work-engaging pad on its end therethrough toward an aligned fixed work pad on the outer leg. The setting mechanism for advancing the stem has a hand lever and hand grip that act in concert upon manual squeezing to step-by-step advance the stem. The setting mechanism removably attaches to the clamp body by a spring-biased lever that grips attachment pins on the body. A latch lever positioned on the inner leg of the clamp body causes a retaining lever to grip the stem when the latch lever is closed and to allow the stem to move freely when the latch lever is open.

However, all of these devices are significantly flawed in that they require relatively complex lifting assemblies, which makes them more expensive, more prone to extensive repairs, and more difficult to easily, properly operate. Thus, there is a clear need for an improved lifting stand that utilizes a relatively simple, inexpensive lifting device that is sturdy and reliable.

Chang U.S. Pat. No. 4,081,112 discloses a caulking gun assembly that provides means by which to easily move an elongate shaft through a housing unit with substantial force by means of a hand actuated trigger. This device has relatively few moving parts and is inexpensive to manufacture. However, as disclosed, the device is designed only for use as a caulking gun, and makes no provision for it to be used as a lifting device.

All of the prior art devices are significantly limited in that they have a relatively large size that is not conducive to use in limited space environments, such as those typically associated with furnace room installations. Thus, there is a clear need for an improved device that is as narrow and compact as possible. Such a device would be less expensive and more effective at lifting and supporting heavy objects than prior art devices. The present invention fulfills these needs and provides further related advantages as described in the following summary.

SUMMARY OF THE INVENTION

The present invention is an improved lifting, and supporting apparatus particularly useful in aiding in the installation, repair and removal of large or heavy equipment such as furnace or air-conditioning units, thus quickening the procedure and preventing injury to those performing the service. The apparatus consists generally of two vertical poles telescopically engaged with one another. A horizontally oriented bracket extends from the upper pole so as to provide a surface upon which the object to be lifted rests. A lifting device is secured to the lower pole so as to provide a means by which to easily and quickly raise or lower the pole assembly. The lifting device is of very simple construction, preferably similar to that of a standard caulking gun so that by simply pivoting a hand-actuable lever, the pole and bracket assembly, and thus the object resting on bracket, is raised further from the ground. It is therefore an object of the present invention to provide a lifting device that is strong enough to lift and support heavy objects, while still being a low cost, relatively simple item that is easily mass produced. It is another object of the present invention to telescopically interconnect the two poles so that the height of the pole assembly is easily adjusted, thus giving the user the ability to use the tool even when a given situation has limited height clearance. Still further, it is an object of the present invention to have a size that is considerably more narrow than prior art devices so as to allow the apparatus to be used in limited space environments, such in the close confines of many furnace rooms in which there is as little as four-inches of space between the furnace and the wall. These are considerable advantages of the present invention, as installers are frequently injured frown reaching out and lifting heavy objects from an awkward position due to space limitations.

It is yet another object of the present invention to provide a means by which to raise and lower the bracket on the upper pole, so that, when used in conjunction with the telescoping abilities of the two poles, the bracket can be easily positioned at a rather wide range of heights so as to precisely correspond with the height of any given object. It is another object of the invention to provide a bracket that can be rotated 180° around the pole so that the same apparatus can be used to support either the left side or the right side of an object, thus keeping production costs of the device down. It is yet another object of the present invention to provide an upfacing lip on the bracket for preventing an object from inadvertently sliding out of position on the bracket and to construct the bracket just thin enough to be wedged into place between two objects so that the top item can be easily lifted off the bottom one without requiring that the top object be slightly lifted off of the bottom one. Still further, the bracket is easily removable from the upper pole so that a variety of different shaped and sized brackets may be secured to the pole in accordance with the needs of a particular object.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a lifting and supporting apparatus. In such drawings.

DETAILED DESCRIPTION OF THE PREFERRED EMBODIMENT

Figure 1:
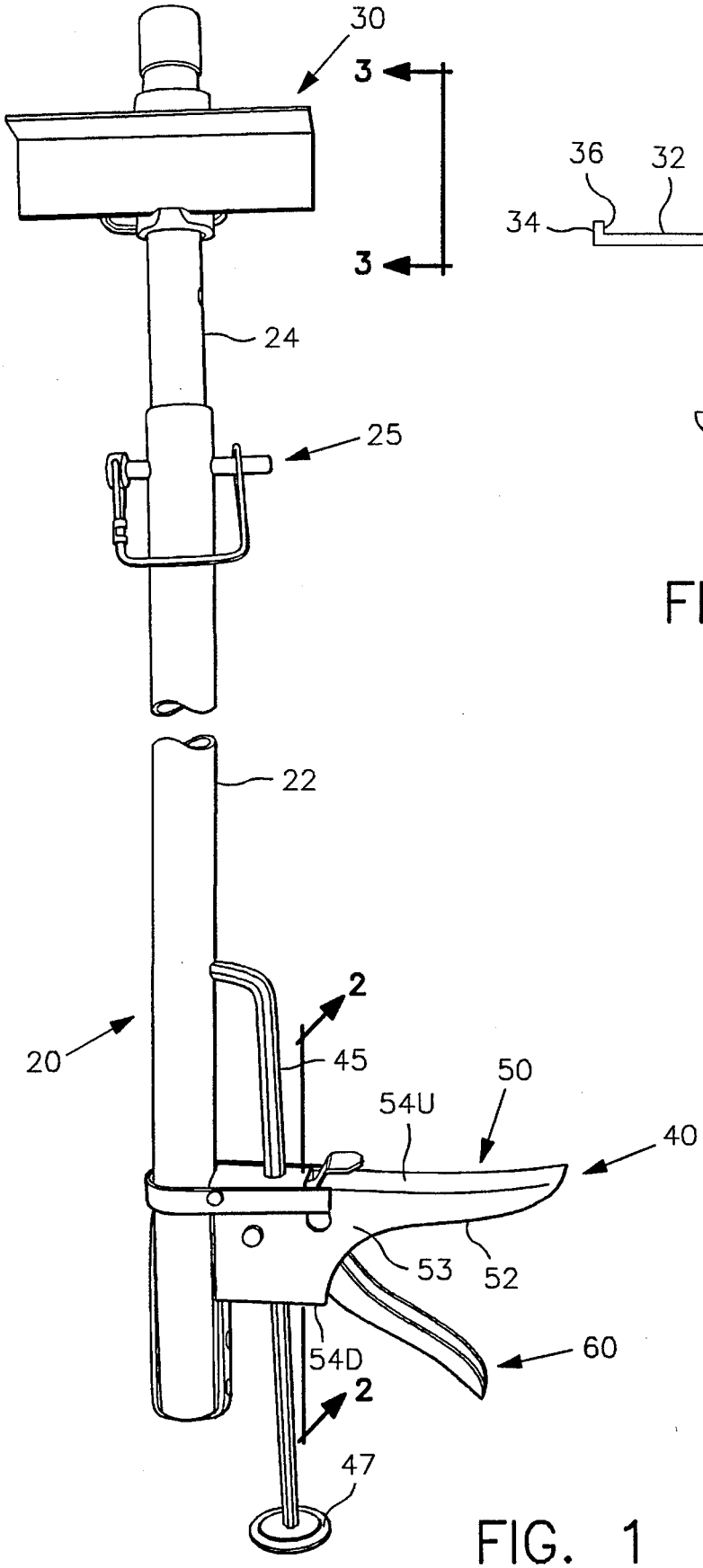
FIG. 1 is a perspective view of the preferred embodiment of the present invention shown in an vertical position as when used.
Figure 3:
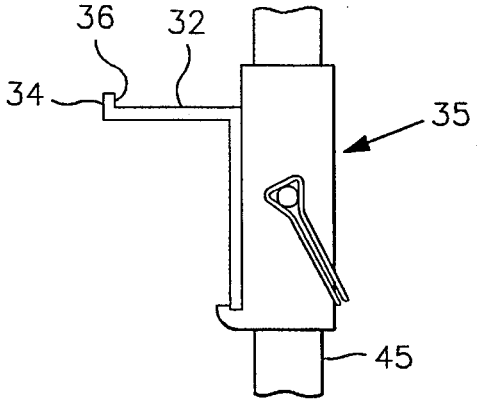
FIG. 3 is a partial side view of the invention of FIG. 1, particularly showing the configuration of an object resting means of the invention.
Figure 2:
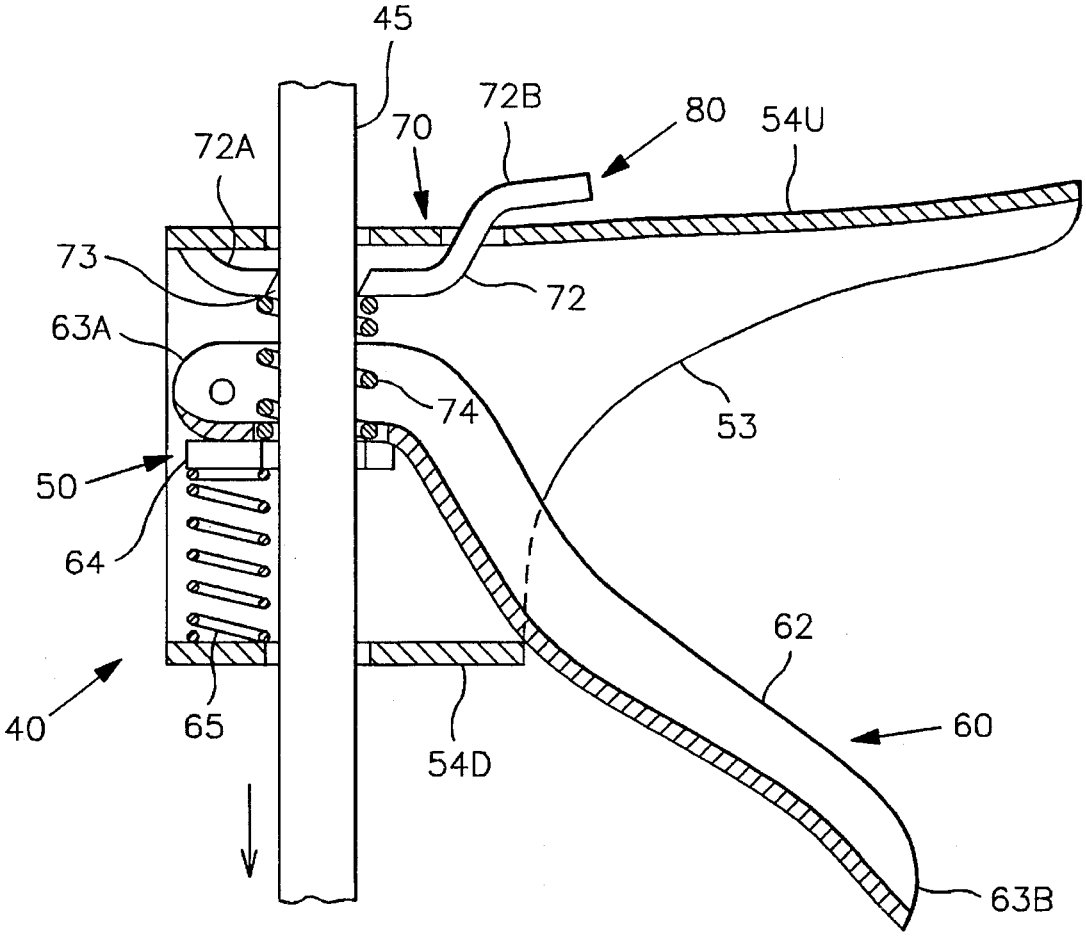
FIG. 2 is a cross section view of a portion of the invention of FIG. 1, particularly showing the internal details of the lifting means of the invention.

FIGS. 1–3 show a lifting and supporting apparatus designed to aid in lifting and supporting heavy objects.

The main structural element of the apparatus is an elongate, vertically oriented tube 20 that preferably consists of two or more telescopically inter-engaged first 22 and second 24 tube portions. The telescopic engagement of the tube portions allows the second tube portion 24 to be easily slid further into or out of the first tube portion 22 so as to increase the overall length of the tube as needed. The tube 20 also includes a means 25 for releasably securing the tube portions at a desired overall length. In one preferred embodiment, illustrated in FIG. 1, the securing means 25 consists of a single aperture in the end of the first tube portion 22 and a plurality of spaced apart, vertically aligned apertures positioned in the second tube portion 24. When the second tube 24 is positioned within the first tube portion 22 so as to achieve the desired overall tube length, the appropriate aperture in the second tube portion 24 is aligned with the aperture in the first tube portion 22 and a securing means 25, such as a securing pin, is positioned through the apertures, thus preventing the tube portions from sliding out of position until the securing pin is manually removed. While this is one preferred embodiment of the securing means 25, it should be noted that the present invention is in no way limited to this particular embodiment, as there are many other possible embodiments of the securing means 25 well known in the art that may be also successfully incorporated within the present apparatus to achieve the same end.

An object resting means 30 is positioned on the upper second tube portion 24. The exact size and shape of the object resting means 30 depends upon the nature of the objects which the apparatus is designed to lift or support. In general, however, the object resting means 30 provides an upfacing surface 32 with an upfacing lip 34 positioned so that a portion of the object rests upon the upfacing surface 32 and is firmly engaged with an edge 36 of the lip 34 so that the object can not inadvertently slip out of engagement with the resting means 30. This configuration is best seen in FIG. 3. The object resting means 30 preferably includes a position adjustment means 35 that allows the resting means to be moved to and secured at any one of a plurality of positions along the tube 20. Preferably, the adjustment means 35 consists of an aperture in the resting means, the object resting means 30 being positionable along the length of the second tube portion 24 so that the aperture in the resting means is aligned with one of the apertures in the second tube portion 24 and a securing pin is used to secure the selected position of the resting means 30. As with the securing means 25, however, there are many possible embodiments of the position adjustment means 35 well known in the art that may alternately be implemented within the scope and spirit of the present invention.

A means for lifting the tube vertically 40 is positioned at the lower first tube portion 22. The lifting means 40 includes an elongate rod 45 that is positioned adjacent to, and in parallel alignment with, the elongate tube 20. The rod 45 is slidably engaged within a drive means 50 which interconnects the tube 20 and the rod 45. The rod 45 preferably has a foot 47 pivotally engaged at a downward end of the rod, the foot 47 designed to contact a floor or ground surface (not shown) upon which the apparatus rests. A non-skid means (not shown), such as a high friction coefficient rubber covering, is preferably positioned on the foot 47 so as to be in contact with the ground surface and prevent the apparatus from sliding across the ground surface. As illustrated in FIG. 1, the drive means 50 is preferably contained within a housing unit 52 preferably having two congruent side walls 53 and an upfacing and downfacing wall, 54U and 54D respectively.

The drive means 50 provides a hand manipulation means 60 to draw the rod 45 through the drive means housing 52 in a downward direction. When the foot 47 of the rod 45 is firmly positioned against the ground surface, the downward movement of the rod 45 forces the tube 20 to move upwardly, thus increasing the tube's overall height from the ground surface. In one preferred embodiment, the hand manipulation means 60 includes a lever 62 with an end 63A contained and secured within the drive means 50 so as to pivot around the rod 45 and an end 63B that extends outwardly from the drive means 50 so as to serve as a hand-actuable trigger. An elongate washer 64 is positioned on the rod 45 adjacent to the secured end 63A of the lever, and a bias means 65 is positioned between the washer 64 and the housing's downfacing wall 54D so that when the outwardly extending end 63B of the lever 62 is drawn toward the upfacing wall 54U of the drive means housing 52, the secured end 63A of the lever 62 pivots into contact with the washer 64 and pushes it downwardly toward the downfacing wall 54D of the drive means housing 52, thus compressing the bias means 65. The pivotal motion of the lever 62 causes the washer 64 to move both downwardly and inwardly toward the rod 45. Therefore, as the outwardly extending end 63B of the lever is drawn toward the upfacing wall 54U, the washer 64 is forced into contact with the rod 45, thus driving the rod 45 to move downwardly with respect to the drive means 50 and tube 20. When the outwardly extending end 63B of the lever is released, the bias means 65 forces the lever 62 back into its original position and the washer 64 moves out of contact with the rod 35. While this is one preferred embodiment of the hand manipulation means 60, there are other similar embodiments known in the art that may also be implemented within the scope of the present invention.

A clutch means 70 is provided for maintaining the rod 45 at a selected linear position within the drive means 50. In one preferred embodiment, the clutch means 70 consists of an elongate clutch plate 72 having an aperture 73 sized for receiving the rod 45 and a bias means 74 positioned between the aperture 73 and the lever 62 of the hand manipulation means 60. A first end 72A of the clutch plate 72 is in pivotal contact with the upfacing drive means wall 54U and a second end 72B of the clutch plate extends through the upfacing wall 54U and outwardly from the drive means 50, as seen in FIG. 2. Normally the clutch plate 72 is biased so that one or more of the plate edges surrounding the aperture 73 firmly engage the rod 45, thus preventing the rod 45 from moving until the hand manipulation means 60 is actuated. The second, outwardly extending end 72B of the clutch plate 72 forms a release means 80. When the second end 72B of the clutch plate is pushed toward the upfacing housing wall 54U, the first end 72A of the clutch plate 72 pivots against the upfacing wall so that the plate is moved out of its normal position and the edges 75 surrounding the aperture are moved out of contact with the rod 45, thus allowing the rod 45 to slide freely through the drive means housing 42.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A lifting and supporting apparatus comprising:

an elongate, structural, vertically oriented, tube having, at one end thereof, a means for resting an object, and, at the other end thereof, a means for lifting the tube vertically;

the lifting means including an elongate rod positioned adjacent to, and in parallel with the elongate tube, and slidably engaged within a drive means, the drive means interconnecting the tube and the rod and providing means for moving the rod downwardly with respect to the tube thereby raising the object resting means, the moving means including:

a lever contained and pivotally secured within the drive means so as to pivot around the elongated rod:

an elongate washer engaged with the elongate rod;

and a bias means positioned so that when the lever is actuated, the lever pivots into contact with the washer pushing it downwardly compressing the bias means, the washer moving into contact with the rod, forcing the rod downwardly with respect to the drive means and tube.

2. The apparatus of claim 1 wherein the tube comprises telescopically inter-engaged first and second tube portions extensible for varying an overall length of the tube, and a means for securing the rod portions at, at least one said overall length.

3. The apparatus of claim 2 wherein the drive means includes hand manipulation means for drawing the rod in a downward direction, and clutch means for maintaining the rod at a selected linear position within the drive means, and release means for releasing the rod from the clutch means, the rod thereby moving freely for repositioning within the drive means.

4. The apparatus of claim 1 wherein the elongate rod includes a foot pivotally engaged at a downward end of the rod, the foot having a non-skid means for contacting a ground surface for resting the apparatus upon.

5. The apparatus of claim 1 wherein the object resting means provides an upfacing surface and an upfacing lip, the lip including an edge for engaging the object.

6. The apparatus of claim 5 wherein the object resting means includes a position adjustment means for fixedly locating the object resting means at any one of a plurality of positions along the tube.

* * * * *